United States Patent [19]

Ali et al.

[11] 4,401,438

[45] Aug. 30, 1983

[54] MATCH PANEL STRIKER

[76] Inventors: Khayyam Ali, c/o George Spector, 3615 Woolworth Bldg., 233 Broadway; George Spector, c/o Khayyam Ali, 3615 Woolworth Bldg., 233 Broadway, both of New York, N.Y. 10007

[21] Appl. No.: 344,884

[22] Filed: Feb. 1, 1982

[51] Int. Cl.[3] ..... A24F 27/10

[52] U.S. Cl. ..... 44/45; 44/48; 206/137

[58] Field of Search ..... 44/42, 44, 45, 48; 206/96, 100, 102, 103, 112, 137

[56] References Cited

U.S. PATENT DOCUMENTS

| | | | |
|---|---|---|---|
| 66,770 | 7/1867 | Adamson | 44/48 |
| 255,605 | 3/1882 | Donnelly | 44/48 |
| 483,166 | 9/1892 | Pusey | 44/44 |
| 791,749 | 6/1905 | Chamberlain | 44/48 |
| 2,076,137 | 4/1937 | Wilson | 44/44 |

FOREIGN PATENT DOCUMENTS

| | | | |
|---|---|---|---|
| 357153 | 12/1905 | France | 44/48 |
| 303405 | 12/1932 | Italy | 44/45 |

*Primary Examiner*—Carl F. Dees

[57] ABSTRACT

A wall mounted device including a scratching surface on a front side for striking matches thereupon, the device including a flat panel surrounded by a frame.

2 Claims, 7 Drawing Figures

MATCH PANEL STRIKER

This invention relates generally to wall mounted, match striking surfaces.

It is well known that often a smoker finds no surface on which to strike a match in order to light a cigarette or pipe, particularly in case the match striking surface on an outer side of his safety matchbook becomes damp or wet either from rain or from perspiration which being carried in a pocket. If there is no other matchbook to be found in the house, he may try to get a light from a piece of paper ignited on a burner of a kitchen stove. But this is dangerous fire hazard, so that the situation is accordingly in need of an improvement.

Therefore it is a principal object of the present invention to provide a match striking surface which is mountable on a wall of a room so to always be handy for a safety match or regular sulphur match to be struck thereupon in order to be ignited.

Another object is to provide a match striking surface which is design either as a broad panel surrounded by a frame or else as a frame around a picture.

Still a further object is to provide a wall mounted, match striking device which includes a supply of matches located upon the frame area thereof.

Figure 1:
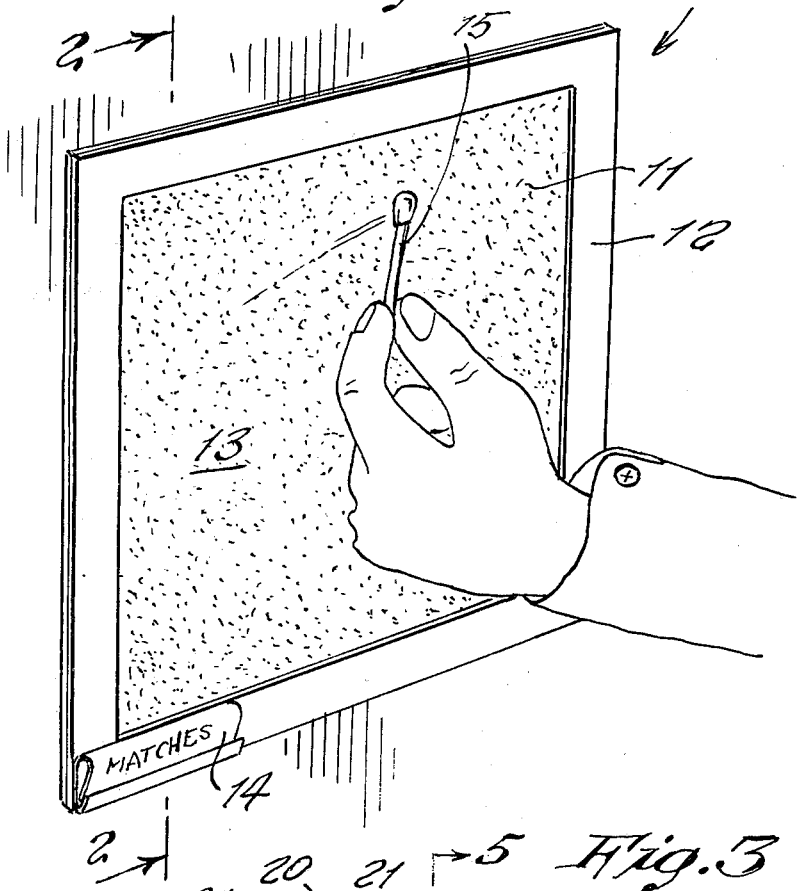
FIG. 1 is a perspective view of one design of the invention shown mounted on a wall, and a match being struck on it.
Figure 2:
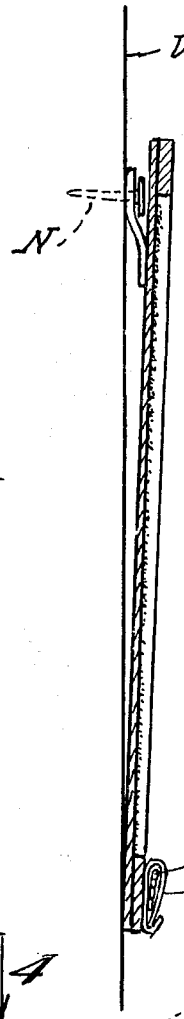
FIG. 2 is a cross sectional view on line 2—2 of FIG. 1.

Referring now to the drawing in greater detail, and more particularly to FIGS. 1 and 2 thereof, at this time, the reference numeral 10 represents a match panel striker according to the present invention wherein a flat, central panel 11 is surrounded by a frame 12, and a front side of the panel is coated with an abrasive material 13 that is a same as the material on an outer side of a conventional safety matchbook for matches to be struck thereupon, in order to ignite the match. While the material 13 is designed generally for safety match use, it could be additionally adaptable for conventional sulphur matches to also be struck thereon.

A packet 14 of matches 15 is attached to a front side of the frame, as shown. The device is hung by a mail or to a wall. In use, the match is simply struck across the surface of the material 13 so to ignite it.

Figure 5:
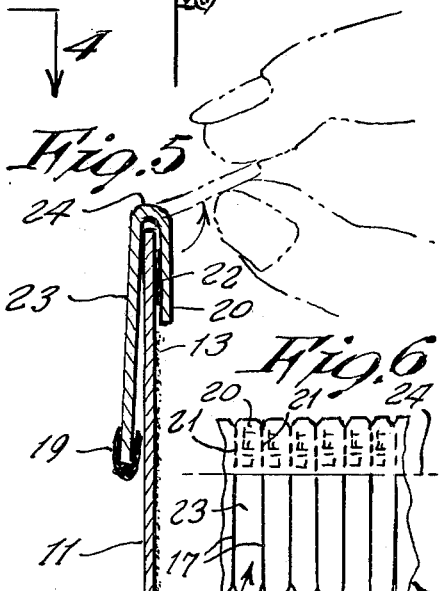
FIG. 5 is a cross sectional view on line 5—5 of FIG. 3, and showing one of the matches being torn off for use.
Figure 6:
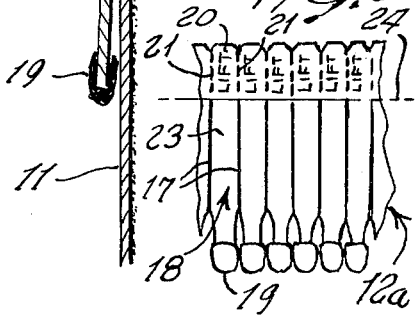
FIG. 6 is a detail of the match frame before being folded over and glued to the back panel.
Figure 4:
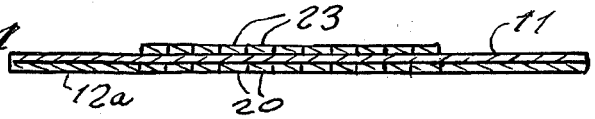
FIG. 4 is a cross sectional view on line 4—4 of FIG. 3.

In another design 16 thereof, shown in FIGS. 3 through 6, the frame **12*a* is made to include a plurality of matches 15*a* formed therearound, by means of a row of transverse slits 17 across an outer area thereof to define match sticks 18, the frame 12*a* being die cut from a flat sheet of cardboard. An outer tip of each match stick is dipped in an ignitable material 19 such as is used in the conventional manufacture of safety match heads. The inward portions 20 of the match sticks, thus formed, are defined between rows of perforations 21 that align with the slits 17. A word "lift" may be printed on a front side of the match stick portions 20. The frame 12*a* is flued to a front side of the edges of the central panel 11, as shown at 22, and the outer portions 23 of the match sticks defined between the slits 17 are bent around a fold line 24 so that these match stick portion 23 are bent around a rear side of the panel 11, as shown in FIG. 5, so that the ignitable match heads are thus protectively hidden for any spark accidently reaching them when another match is struck across the front of the panel. When a person needs a match, he simply lifts the portion 20 of one of the match sticks so to tear it off along the perforations, as shown by the phantom lines in FIG. 5**.

Thus the match is pulled free from the frame in order to be then used by stricking it across the material 13 on the front side of panel 11.

Figure 7:
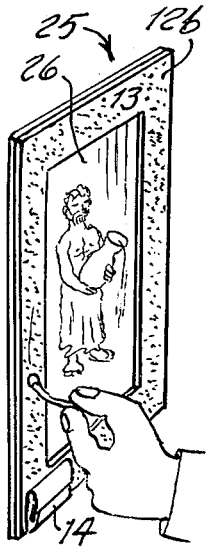
FIG. 7 is a perspective view of still another design of the invention, wherein the match striking surface is on a frame around a central, displayed picture.
Figure 3:
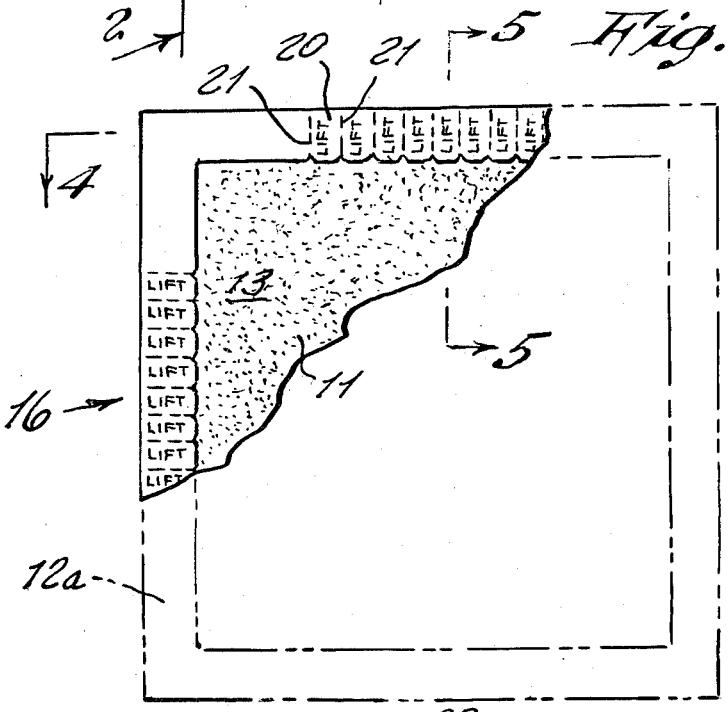
FIG. 3 is a front view of another design in which the frame is made out of matches.

In still another design 25 of the invention, the material 13 is applied to the front side of the frame **12*b* while the panel 11*a* has a decorative picture 26 displayed on its front side, instead, so that in this design, the match is struck upon the frame, instead, as shown. The picture illustrated in FIG. 7** is that of Aquarius, the water bearer, which is one of the Zodiac signs.

While various changes may be made in the detail construction, it is understood that such changes wll be within the spirit and scope of the present invention as is defined by the appended claims.

What is Claimed:

1. An article of manufacture on which a match can be struck, comprising in combination a wall mounted panel and a frame around said panel, an abrasice material coated on a front side of said panel as to ignite said match when struck thereacross, and a plurality of matches forming part of said frame.

2. The combination as set forth in claim 1, wherein a head of each match is bent around an edge of said panel to a rear side thereof and wherein the opposite end of each match are joined by perforated material extending from the rear side of the panel to the front side thereby forming a portion of the frame.

* * * * *